US005982326A

United States Patent [19]

Chow et al.

[11] Patent Number: 5,982,326

[45] Date of Patent: Nov. 9, 1999

[54] ACTIVE MICROPATCH ANTENNA DEVICE AND ARRAY SYSTEM

[76] Inventors: Yung Leonard Chow, 18 Post Horn Place, Waterloo, Ontario, Canada, N2L 5E1; Saffieddin Safavi-Naeini, 301 Hiawatha Drive, Waterloo, Ontario, Canada, N2L 2V9

[21] Appl. No.: 08/897,569

[22] Filed: Jul. 21, 1997

[51] Int. Cl.[6] ..... H01Q 21/24

[52] U.S. Cl. ..... 342/365; 343/700 MS

[58] Field of Search ..... 342/363, 365, 342/372, 373, 370; 343/700 MS

[56] References Cited

U.S. PATENT DOCUMENTS

| | | | |
|---|---|---|---|
| 3,725,943 | 4/1973 | Spanos | 343/797 |
| 3,827,051 | 7/1974 | Foldes | 343/176 |
| 4,163,235 | 7/1979 | Schultz | 343/100 SA |
| 4,408,206 | 10/1983 | Fitch et al. | 342/352 |
| 4,737,793 | 4/1988 | Munson et al. | 342/361 |
| 5,631,898 | 5/1997 | Dent | 370/203 |
| 5,642,358 | 6/1997 | Dent | 370/323 |
| 5,774,045 | 6/1998 | Helma et al. | 340/436 |

*Primary Examiner*—Thomas H. Tarcza
*Assistant Examiner*—Dao L. Phan
*Attorney, Agent, or Firm*—Fitzpatrick, Cella, Harper & Scinto

[57] ABSTRACT

An active microwave antenna device includes a two-port micropatch antenna which receives signals having a first circular polarization and transmits signals of opposite circular polarization. The device includes an integrated active circuit for amplifying and, optionally, filtering the signal. An array of such devices can be formed on a single substrate, each device being an independent active antenna, thus eliminating the need for RF or IF feed networks between the devices. Such arrays are believed to be particularly suitable for spatial power combining, rapid beam scanning, microwave imaging, frequency-polarization selective processes, and other related applications. The arrays may be either reflective or transmissive.

9 Claims, 8 Drawing Sheets

ACTIVE MICROPATCH ANTENNA DEVICE AND ARRAY SYSTEM

FIELD OF THE INVENTION

This invention relates to active antenna elements and phased array systems using such elements. In particular, this invention relates to active circularly-polarized micropatch antenna devices and phased array systems using such elements.

BACKGROUND OF THE INVENTION

Microstrip and micropatch microwave antenna elements are known in the art. They generally consist of a conductive or semiconductive material applied to a dielectric substrate by known techniques, such as sputtering, vapour deposition, and masking techniques. An element is active if, through an active circuit, for example an MMIC, it amplifies a received or transmitted signal.

The integration of antennas and active circuits is of great interest for: quasi-optical, spatial power combining, phased arrays; spatial frequency and polarization sensitive surfaces; and direct receiving arrays for microwave and sub-millimeter waves. In addition, there is great interest in using planar active arrays for microwave/millimeter wave imaging systems and radiometers in applications such as remote sensing, environmental studies, radio cameras, and radio astronomy.

For many practical applications, a number of discrete elements, up to several thousand, are applied to a substrate to form a phased antenna array. Generally, prior art phased arrays require complex feed networks for RF or IF signals. These networks can be highly lossy, bulky and expensive to design and produce.

Such feed networks are generally provided by microstrip transmission lines interconnecting the elements to a common feed. The networks are generally symmetrical patterns of transmission lines designed to feed signals in phase to or from the antenna elements. Therefore, beyond the complexity and attendant expense of providing such RF and IF feed networks, the failure of single transmission line or element can lead to catastrophic failure of the array by cutting the received or transmitted power from the array by up to half. For this reason, power combining in space using quasi-optical techniques with no feed network has emerged as an attractive alternative. This is especially useful at millimeter and sub-millimeter wavelengths where the feed networks are typically complicated, bulky, and lossy.

Various radiating array architectures have been proposed for output power combination. R. M. Weikle II et al., "Planar MESFET grid oscillator using gate feedback," IEEE Trans. Microwave Theory Tech., vol. MTT-40, pp. 1997–2003, 1992, and J. Birkeland et al., "A 16 element quasi-optical FET oscillator power combining array with external injection locking," IEEE Trans. Microwave Theory Tech., vol MTT-40, pp. 475–481, 1992 describe the use of number of sets of solid state oscillators as a power combining array. J. B. Hacker et al., "A 100 element planar Schottky diode grid mixer," IEEE Trans. Microwave Theory Tech., vol. MTT-40, pp. 557–562, 1992, discloses mixers forming a power combining array. J. A. Benet et al., "Spatial power combining for millimeter wave solid state amplifiers," 1993 IEEE MTT-S Int. Microwave Symp. Digest, Atlanta, pp. 619–622, and M. Kim et al., "A 100-element HBT grid amplifier" 1993 IEEE MTT-S Int. Symp. Digest, Atlanta, pp. 615–618, 1993 describes sets of amplifiers, each set integrated only with its own planar patch, radiating into space. The structures described in Benet et al. and Kim et al., respectively, are related to reflecting and transmitting amplifier surfaces. However, they are limited to the reflection and transmission of linearly polarized waves.

Active receiving, or transmitting, array architectures composed of active elements are also reported in the literature. Examples of such array architectures are described in W. Chew et al., "Printed circuit antennas with integrated FET detectors for millimeter-wave quasi optics", IEEE Trans. Microwave Theory Tech., vol. MTT-37, pp. 593–597, 1989; S. Weinreb, "Monolithic integrated circuit imaging radiometers," 1991 IEEE MTT-S Int Microwave Symp. Digest, Boston, pp. 405–408; K. Uehara et al., "Lens-coupled imaging arrays for the millimeter- and submillimeter-wave regions," IEEE Trans. Microwave Theory Tech., vol. MTT-40, pp. 806–811, 1992; and G. S. Dow et al., "W-band MMIC direct detection receiver for passive imaging system," 1993 IEEE MTT-S Int. Microwave Symp. Digest, Atlanta, pp. 163–166, 1993.

There are several drawbacks to the above designs. Generally, they tend to be expensive, and, therefore, unsuited to price sensitive commercial applications. It is necessary to custom design the elements and arrays for each application. And, in particular for oscillator power combining techniques, they are not suitable where amplification is required. Moreover, separate arrays are generally required for receiving and transmitting.

SUMMARY OF THE INVENTION

It is an object of the present invention to provide a novel active micropatch antenna device including an integrated active circuit which obviates or mitigates at least one disadvantage of the prior art.

It is a further object of the present invention to provide a novel phased array of micropatch antenna devices without microstrip RF or IF links between devices which obviates or mitigates at least one disadvantage of the prior art.

According to a first aspect of the present invention, there is provided an active integrated antenna device comprising:

an antenna subsystem including an antenna element having first and second ports, said ports being operably electrically connected to a hybrid circuit having phase shifting means for receiving a signal having circular polarization through said first port and returning a signal of opposite circular polarization through said second port; and an integrated active circuit operably electrically connected to said hybrid circuit wherein said active circuit includes amplifying means for amplifying said signal of opposite circular polarization.

According to another aspect of the present invention, there is provided an integrated antenna array system comprising:

a plurality of micropatch antenna devices integrally formed on an substrate;

wherein each said antenna devices is an independent antenna device including an antenna subsystem having means for receiving a signal having a first circular polarization and transmitting a signal of opposite circular polarization, said antenna subsystem being electrically operably connected to an integrally formed active circuit, said active circuit including means for amplifying said signal of opposite circular polarization.

According to a further aspect of the present invention, there is provided a microwave communication system comprising:

a microwave source for providing at least one microwave signal having a first circular polarization;

an integrated antenna array for receiving said at least one signal, said array comprising a plurality of micropatch antenna devices, wherein each said antenna devices is an independent antenna device including an antenna subsystem having means for receiving said at least one signal and transmitting at least one signal of opposite circular polarization, said antenna subsystem being electrically operably connected to an integrally formed active circuit, said active circuit including means for amplifying said at least one signal of opposite circular polarization; and a reflector for receiving and reflecting said at least one amplified signal of opposite circular polarization to a receiving means.

According to a further aspect of the present invention, there is provided a microwave imaging system comprising:

an integrated antenna array for receiving said at least one microwave signal having a first circular polarization, said array comprising a plurality of micropatch antenna devices, wherein each said antenna devices is an independent antenna device including an antenna subsystem having means for receiving said at least one signal having a first circular polarization and transmitting at least one signal of opposite circular polarization, said antenna subsystem being electrically operably connected to an integrally formed active circuit, said active circuit including means for amplifying said at least one signal of opposite circular polarization; and an imaging means for receiving said at least one amplified signal, said imaging means comprising means for detecting an intensity of said at least one amplified signal at a plurality of points on said imaging means.

BRIEF DESCRIPTION OF THE DRAWINGS

Preferred embodiments of the present invention will now be described, by way of example only, with reference to the attached Figures, in which.

DETAILED DESCRIPTION

Figure 1:
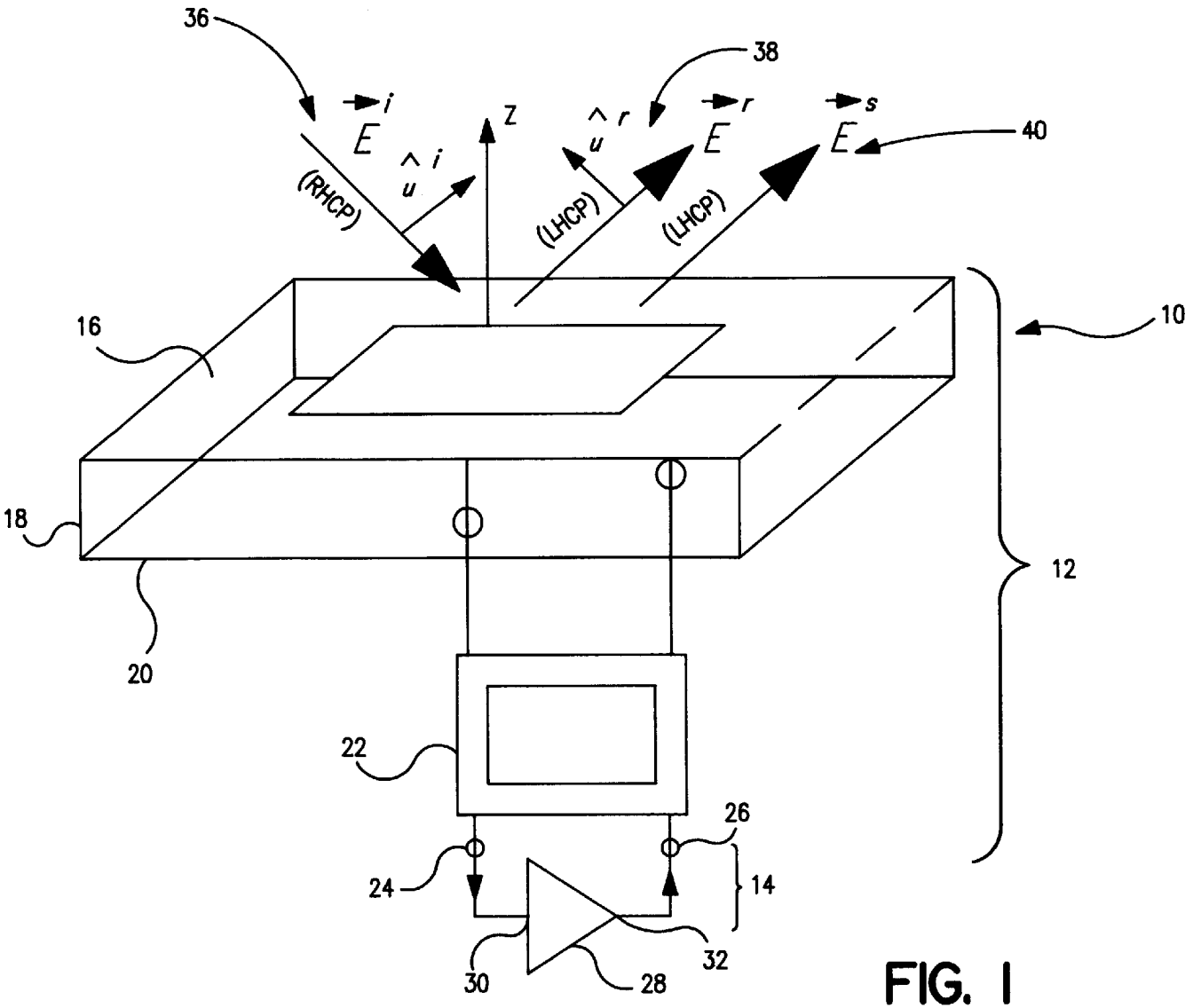
FIG. 1 is a perspective view of an active micropatch antenna device, in accordance with the present invention.

An embodiment of an active micropatch antenna device of the present invention is illustrated in FIG. 1, and generally designated by reference numeral 10. An active antenna device is generally defined as one in which the input signal is amplified to produce an amplified output signal.

Device 10 is a dual circularly polarized active device consisting of an antenna subsystem 12 and an integrated active circuit 14. Antenna subsystem 12 consists of a micropatch antenna element 16 mounted on a dielectric substrate 18 and backed by a grounded conducting backplate 20. Antenna element 16 is electrically connected to a branch line hybrid circuit 22. Hybrid circuit 22 is electrically connected to active circuit 14 through two ports, a right-hand circularly polarized ("RHCP") port 24 and a left-hand circularly polarized ("LHCP") port 26, which are themselves interconnected by a low noise amplifier 28. An input 30 to amplifier 28 receives input from RHCP port 24, through hybrid circuit 22. An output 32 of amplifier 28 transmits output to LHCP port 26.

Antenna element 16 is illustrated as having a generally rectangular form, but, as will be apparent to those of skill in the art, antenna element 12 can also be circular, elliptical or other appropriate shape. Hybrid circuit 22 is a conventional branch line hybrid circuit which effects a 90° phase shift on an input signal. Thus, in the example above, an RHCP input signal can be transformed into an LHCP output signal. Electrical connections between the various components of device 10 can be formed by conventional microstrip technology, as is known to those in the art.

In operation, when antenna element 16 is illuminated by an RHCP incident plane wave 36, the part of the incident power received by the antenna is delivered by RHCP port 24 to amplifier 28. This part will be amplified and reradiated by element 16 in the form of an LHCP plane wave 38. Reradiated LHCP wave 38 has the same propagation direction and approximately the same polarization as a back-scattered field 40 generated by the current induced on element 16 and backplate 20. The device 10 can be adjusted so that the reradiated wave 38 and the back scattered field 40 add in phase in the far zone, thereby producing a strong total reflected wave with a power density higher than that of the incident wave 36.

Figure 2:
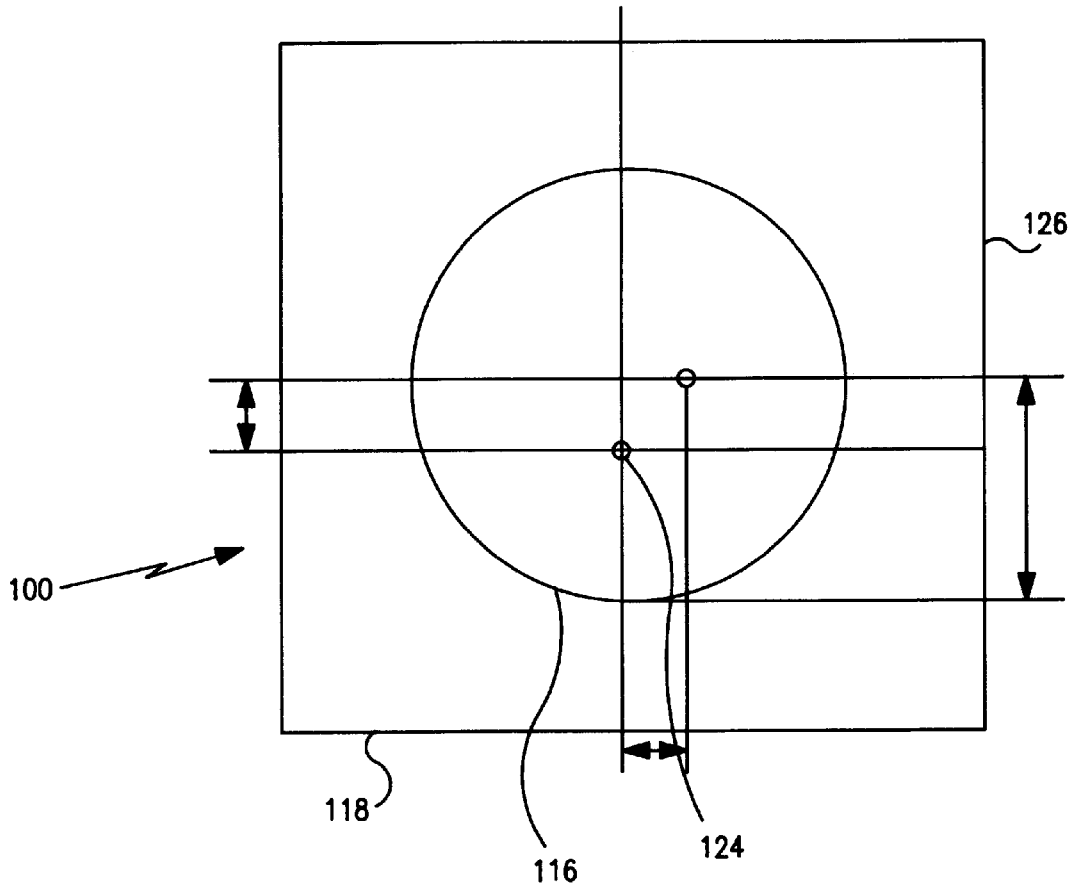
FIG. 2 is top view of an active micropatch antenna device, in accordance with the present invention.
Figure 3:
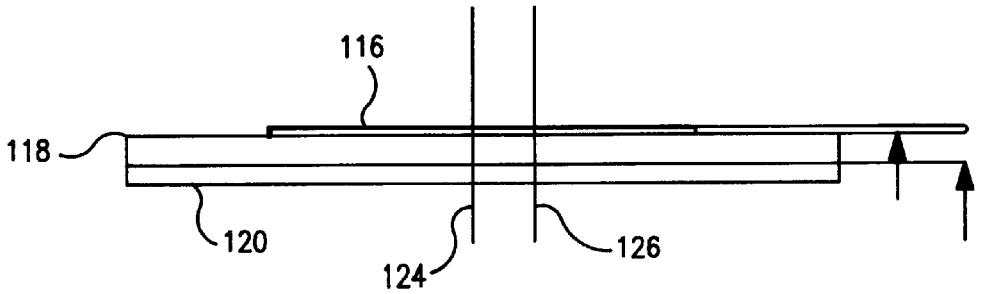
FIG. 3 is a side view of the antenna subsystem of the device in FIG. 2.
Figure 4:
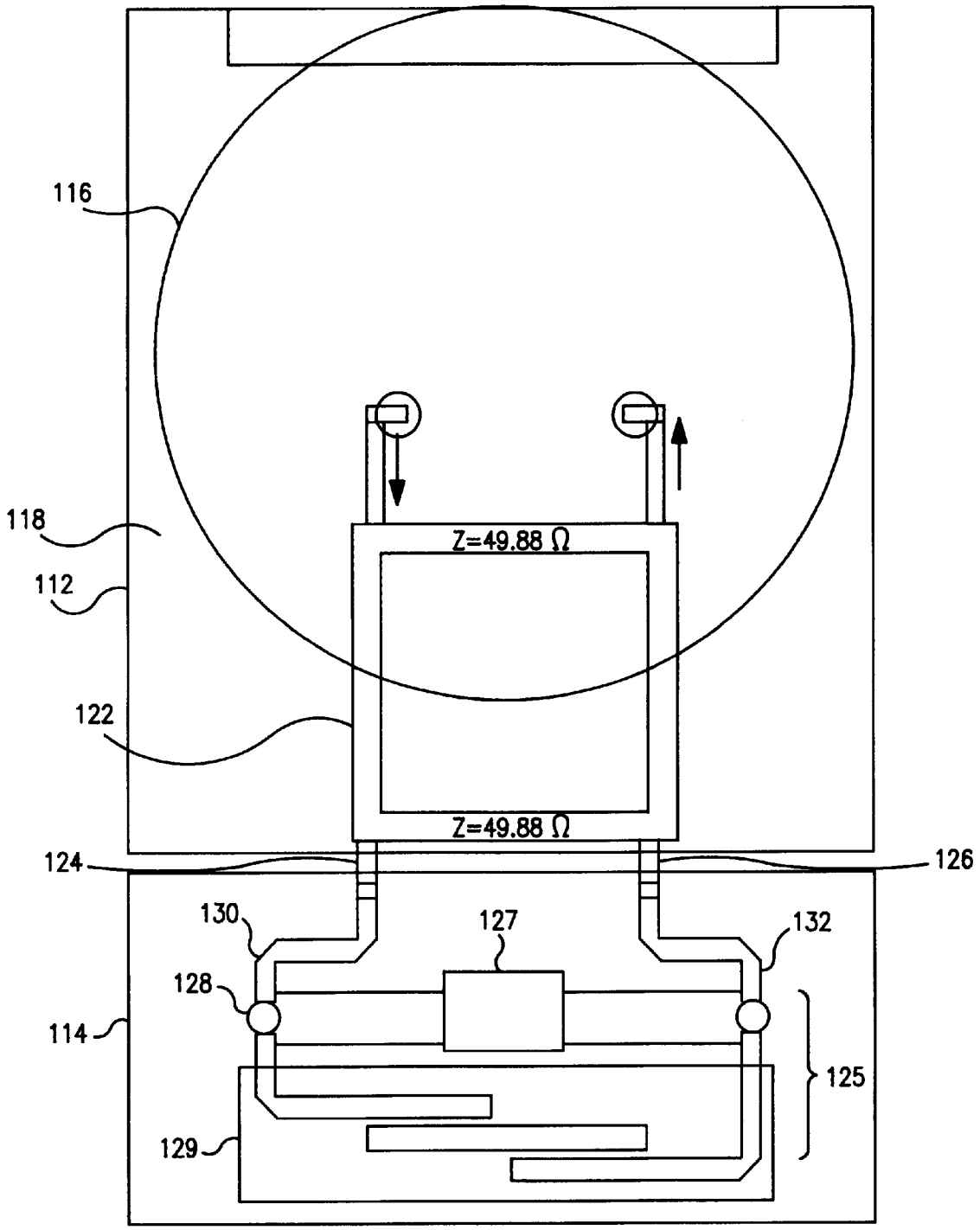
FIG. 4 is a bottom view of the subsystem of FIG. 3 connected to the active circuit.

A second embodiment of an active micropatch antenna device of the present invention is shown in FIGS. 2, 3 and 4, and generally designated as 100. As shown particularly in FIG. 4, device 100 consists of an antenna subsystem 112 and an integrated active circuit 114. Antenna subsystem 112 consists of a micropatch antenna element 116, integrally formed on a dielectric substrate 118 and backed by a grounded conducting backplate 120. Dielectric substrate 118 has an approximate thickness of $\lambda/10$ or less, where $\lambda$ is the free space wavelength of operation, and antenna element 116 has an approximate thickness of $\lambda/100$ or less. It has been found that a dielectric constant in the range of approximately 1 to 13 is appropriate. As shown, antenna element 116 is circular, rather than rectangular as in the first embodiment above. Antenna element 116 is electrically connected to a hybrid circuit 122 which is, in turn, connected to active circuit 114 through two ports, a right-hand circularly polarized ("RHCP") port 124 and a left-hand circularly polarized ("LHCP") port 126.

RHCP port 124 and LHCP port 126 are interconnected by a filtering and amplifying circuit 125 consisting of a bias circuit 127, conventional amplifiers 128 and a narrow band filter 129. An input 130 to filtering and amplifying circuit 125 receives input from RHCP port 124, through hybrid circuit 122. An output 132 of filtering amplifying circuit 125 transmits output to LHCP port 126.

Device 100 operates in a similar manner to that described above, with the addition of narrow band filter 129 to minimize possible spurious oscillations outside the desired bandwidth.

Figure 5:
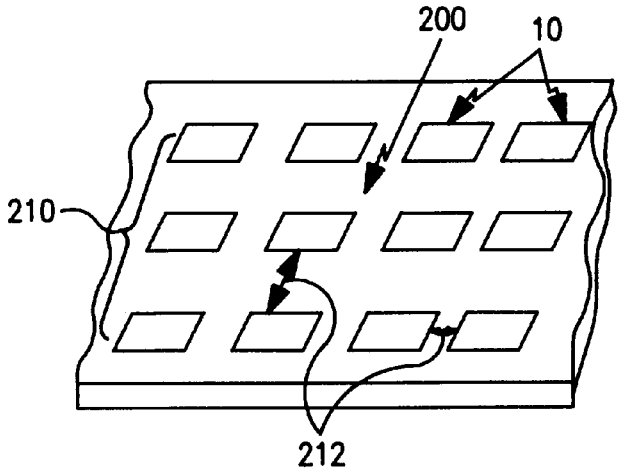
FIG. 5 shows a perspective view of a planar array of antenna devices in accordance with the present invention.

To better understand the operation of an active micropatch antenna device of the present invention, an analysis of the reflection gain and polarization characteristics of such a device is given below. For the purposes of the following analysis, an infinite number of devices 10 are assumed to form a planar reflecting array 200, as partially illustrated in FIG. 5, whereby a received wave is reradiated by each antenna device 10 after desired amplification. The devices 10 are arranged to form a grid 210 wherein each element is separated from its nearest neighbour by a spacing 212.

The planar array 200 is assumed to be an infinite periodic structure in the xy-plane having periods a and b along $\hat{x}$ and $\hat{y}$ directions, respectively. The power gain of the amplifier is assumed to be $|s_{21}^A|^2$. For any polarization, an incident field $E^i$ and a ground reflected field $E^r$ in the half space z>0, produced by the grounded multilayer dielectric substrate in the absence of the antenna elements are given by:

$$E^i = E^i_0 \exp(-jk\cdot r)$$

$$E^i_0 = |E^i_0|\hat{u}^i \tag{1}$$

$$E^r = E^r \exp(-jk\cdot r)$$

$$E^r_0 = |E^r_0|\hat{u}^i = [r]E^i_0 \tag{2}$$

where $\hat{u}^{ir}$ are the complex polarization unit vectors of the incident and reflected waves respectively and [r] is the plane wave reflection matrix of a grounded multilayer dielectric substrate.

The total field, E, in the presence of the elements is the sum of the incident field, reflected field, and scattered field, $E^s$ as given by:

$$E = E^i + E^r + E^s \tag{3}$$

where scattered field $E^s$ is produced by the current induced on element 16 by the incident field E.

The scattered field, E roduced by the surface currents induced on the patches, can be expanded in terms of Floquet's modes, each of which represents a plane wave. Only the (0, 0) Floquet's mode, i.e., the wave propagating along the reflection direction, exists if the following conditions are satisfied:

$$\left|\sin(\theta_0)\cos(\theta_0) + \frac{\lambda}{a}\right| > 1, \left|\sin(\theta_0)\cos(\theta_0) + \frac{\lambda}{b}\right| > 1 \tag{4}$$

where (a, b) are cell separations along x- and y-directions respectively and $(\phi_0, \theta_0)$ are the azimuth and polar angles of incidence. This is the case for the devices of the present invention. Far from the surface the scattered field, $E^s$, is therefore a wave propagating along the reflected wave vector, $k^r$.

For a planar array, we assume the incident field is RHCP ($\hat{u} = \hat{u}^{RHCP} = (\phi_0 + \hat{j}_{B0})/\sqrt{2}$). The reflected field polarization from a grounded thin dielectric layer is almost LHCP and its amplitude is the same as that of the incident field. This results from the fact that when the thickness of a grounded dielectric layer is quite small in terms of wavelength the phase change due to propagation in the dielectric medium is almost zero. Therefore both linear components of the circularly polarized field are reflected back essentially by a perfectly conducting ground plane. This means:

$$\hat{u}^r = [r]\hat{u}^i \approx \exp(-j\psi)\hat{u}^{LHCP}, \ \psi \to 0, \tag{5}$$

where $\hat{u}^{LHCP} = (\phi_0 + j\theta_0)/\sqrt{2}$.

To find the scattered field $E^s$, we assume that the operating frequency is very close to the resonant LHCP mode of the antenna element. In a narrow band of frequencies around the resonance, the induced surface current on the patch, due to an incident plane wave, has essentially a modal distribution. The direction of propagation and the polarization of the incident field only affect the amplitude and the phase of this resonant modal distribution. The scattered field is therefore LHCP. This simplifies the scattering analysis and allows us to draw some general conclusions without rigorously analysing the scattering process.

The scattered field can be decomposed into two constituents:

$$E^S = E^{S0} + E^{SA}$$

where $E^{S0}$, a zero gain scattered constituent, is the scattered field in which the gain of the amplifier has been set to zero, and $E^{SA}$, an amplified reradiated (LHCP) constituent, is the field transmitted by array elements when they are fed by an amplifier output at their LHCP ports, with their RHCP ports terminated by an input impedance, $Z_{in}$. This means that the RHCP port and the LHCP ports are still connected to the input impedance $Z_{in}$ and an output impedance $Z_{out}$ of the amplifier respectively. In this case an amplifier input power, $p_{in}$, is the same as that absorbed by the impedance $Z_{in}$.

Under the condition (4), the fields $E^{S0}$ and $E^{SA}$, far from the planar array, are plane waves propagating along a reflected wave vector, $k^r$ as given by:

$$E^{S0} = E_0^{S0} \exp(-k\cdot r)$$

$$E_0^{S0} = [s]E^i$$

$$E^{SA} = E_0^{SA} \exp(-k\cdot r)$$

$$E_0^{SA} = S_A^u[h]E^i$$

where [s] and [h], in analogy with a plane wave reflection matrix [r], are 2×2 matrices relating the incident field's amplitudes and polarization to those of the zero gain scattered and unit amplifier gain reradiated fields respectively, and $s_{21}^A$ is the transducer gain of the amplifier. It may be noticed that throughout the present analysis, the amplifier is assumed to be unilateral with ($s_{12}^A = 0$).

Figure 6:
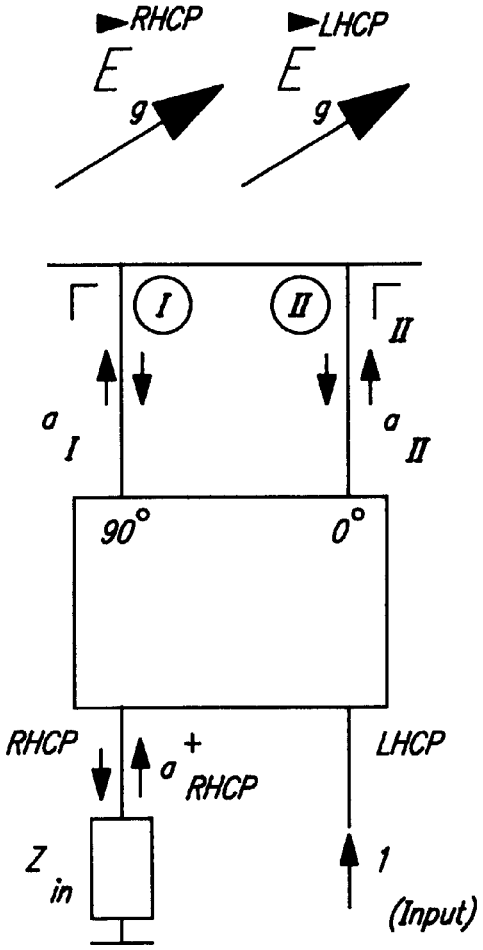
FIG. 6 is a circuit model for a non-ideal unit cell reradiating both LHCP and RHCP components.

The "zero gain" scattering matrix [s] depends on the element structure and its ports terminations as well as the substrate characteristics. This matrix is determined by solving an integral equation for the unknown induced current on the elements due to the incident plane wave by a numerical method, and finding the field radiated by the patches. The unit amplifier gain element reradiation matrix [h] is found by assuming a circuit as illustrated in FIG. 6, solving for $E^{SA}$ and expressing $V_{in}$ in terms of the incident field $E^i$ using the vector "effective length" $h^{RHCP}$ of an antenna element in the array at the direction of incidence while assuming that the amplifier $s_{21}^A = 1$.

Thus, one can easily derive:

$$S_{21}^{\lambda} = \frac{A}{2}(1+\Gamma_{in})(1-\Gamma_{out}) \tag{8}$$

where A is the voltage gain of the amplifier and $\Gamma_{in}$ and $\Gamma_{out}$, are transmission line reflection coefficients at the input and the output of the amplifier respectively.

For widely separated resonant elements, due to low density of elements, the above matrices are relatively small and the reflected field $E^r$ dominates over the scattered field. However, when the spacing between the elements approaches half a wavelength, the scattered field from the high density of the resonant micropatches completely takes over the reflected field.

The amplitude of the total returned field ($E^r=E^{S0}+E^{SA}$), through reflection, scattering and reradiation from the planar array is related to the power dissipated or amplified in each antenna device of the surface. The power reflection coefficient, $R_p$, is defined as the ratio between the total power returned from the surface and the incident power:

$$R_p = \frac{|E^r = E^{SO} + E^{SA}|^2}{|E_o^i|^2} \tag{9a}$$

From the conservation of the power in each antenna device we can derive from (9a):

$$R_p = 1 + \frac{2\eta 0 P}{|E_0^i|^2 \cos(\theta_0) ab} \tag{9b}$$

where $\eta_0$ is the wave impedance of the free space and p represents the power generated in each cell of the surface, in excess to what is being received, minus all dielectric, metallic, circuit, and surface wave losses. It is noted that $|E_0|^2 \cos(\theta_0)ab$ is the density of the incident power normal to the surface.

When there are no losses and the amplifier's input and output are conjugately matched to the hybrid circuit ports then:

$$\rho = (|S_{21}^A|^2 - 1)\mathcal{P}_{i_n} = (|S_{21}^A|^2 - 1)\frac{|h^{RHCP} \cdot E_0^i|^2}{8Re(Z_{i_n})} \tag{10}$$

where $p_{in}$ is the power input to the amplifier and the power ratio $R_p$ becomes:

$$R_p = 1 + 2\frac{\eta_0}{ab\cos(\theta_0)}(|S_{21}^A|^2 - 1)\frac{|h^{RHCP} \cdot \hat{u}^i|^2}{8Re(Z_{i_n})} \tag{11}$$

$$= 1 + (|S_{21}^A|^2 - 1)\frac{|h^{RHCP} \cdot \hat{u}^i|^2 A_e(k^i)}{ab\cos(\theta_0)}$$

where $h^{RHCP}$ is the complex unit vector along $h^{RHCP}$ representing the polarization of the elements at the RHCP ports and $A_e(\hat{k}^i)$ is the effective receiving aperture of each antenna element with matched polarization in the direction of the incident wave($\hat{k}^i$) in the array environment. The factor $|h^{RHCP} \cdot \hat{u}^i|^2$ therefore takes into account any polarization mismatch between the planar array and the incident field.

In a zero gain situation ($s_{21}{}^A=0$), it results from (7b) that $E^{SO}$ and therefore $$E^s = E^{s0} + E^{sA} = E^{s0}$$

Thus, the maximum possible receiving aperture of each element of an infinite array along a given direction of incidence is the area of each element projected normal to that direction. If the antenna elements have the maximum receiving aperture ($A_e$=ab cos ($\theta_0$)) with perfectly matched impedance and polarizations ($|h^{RHCP} \cdot \hat{u}^i|^2=1$), the planar array may become completely absorptive and, from (9), $E^{s0} \rightarrow -E^r$ or $[s] \rightarrow -[r]$.

A planar array with unit gain amplifiers ($s_{21}{}^A=1$) and no dielectric and conductor losses is a lossless reactive surface with frequency and polarization selectivity (FSS) and $R_p=1$ or $|(r+s+h) \cdot \hat{u}^i|^2=1$. The scattered and reflected fields for a thin dielectric substrate are LHCP therefore $[r]\hat{u}^{RHCP}=1\hat{u}^{LHCP}$, $[s]\hat{u}^{LHCP}$, and $[h]\hat{u}^{RHCP}=h\hat{u}^{LHCP}$ where s and h are complex scalars and:

$$|1+s+h|^2 \approx 1 \tag{12}$$

The ratio |s+h| may be viewed as a measure of the strength of the total scattered field (i.e., $E^S=E^{SA}$). As is known, the amplitude of a scattered field from a micropatch with proper reactive loading peaks strongly at resonant frequencies.

Equation (12) is actually a statement of the conservation of power in a lossless, or reactive, reflector. Thus, with appropriately chosen elements and array configuration, the maximum value of the scattered field amplitude is attained when s+h=−2 which means that $E^s=-2E^r$.

Under this condition, one may also conclude that the total field returned from the surface $E^r+E^s \approx -E^r$ is the same as the reflected field from the surface in the absence of the antenna elements but with a phase reversal. In the other words, as far as the total returned far field is concerned, the surface has behaved like a perfectly magnetic conducting (PMC) plane.

In practical applications, equation (11) indicates that if the amplifier power gain overcomes the small surface losses, due to dielectric, conductor, and surface waves, in each antenna device and the total returned power is larger than the input incident power or $R_P>1$. If the amplifier power gains are large enough, the reradiated field, $E_B{}^{LHCP}$ dominates in the total returned wave and under perfectly polarization and impedance matching conditions $$R_P \rightarrow |S_{21}{}^A|^2 A_e / [ab \cos(\theta_0)]$$

In practice, however, to avoid instability due to mutual effects between the nearby elements and the RHCP and LHCP ports at the amplifier input and output, respectively, of each element, a limited power gain may be chosen. In this case, if the incident field has a suitable polarization, RHCP in this case, the zero gain scattered field $\vec{E}^{s0}$ is mainly LHCP which is the same polarization as that of the reradiated component $\vec{E}^{sA}$. If the phase of the antenna amplifier is adjusted so that the two latter fields add in phase in the far region, a considerably high reflective gain ($R_P$) is obtained.

Since the reflected field $\vec{E}^r$ is circularly polarized with a sense of rotation opposite to that of the incident field, the axial ratio $\vec{E}^r$ is the same as that of the incident field. The axial ratio of the scattered field $\vec{E}^s$ varies with both frequency and incidence angle. In beam scanning applications, as will be further described below, the direction of incidence determines beam pointing and therefore the incidence angle has the same meaning as that of the beam scan angle.

Let us consider the amplified reradiated field, $\vec{E}^{sA}$ first. With the above assumptions, the axial ratio, $AR^{sA}$, of the reradiated field is the same as the axial ratio $AR^{LHCP}$ of the radiated field from the LHCP port:

$$AR^{sA}(\hat{k}^i, \omega)=AR^{LHCP}(\hat{k}^i, \omega) \tag{13}$$

when $\hat{k}^i$ is the unit vector along the direction of the incidence and $\omega$ is the radian frequency.

The polarization of the second constituent of the scattered field, or "zero gain" scattered field ($\vec{E}^{s0}$), is predominantly the polarization of the element resonant mode over a narrow band around the resonant frequency. In resonant mode, it can be shown that the amplitude of the element resonant scattered field is proportional to the reciprocity between the incident field and the resonant modal current on the antenna device. In the case of cross-polarized elements in a planar array, the excitation amplitudes of the resonant modal currents, $\vec{J}_I$ and $\vec{J}_{II}$, produce orthogonal linearly polarized (LP) fields $<\vec{E}^i, \vec{J}_I>$ and $<\vec{E}^i, \vec{J}_{II}>$ respectively, where < > denotes reciprocity reaction. By reciprocity it can be shown that these reactions are proportional to $\vec{E}_{I,II}\cdot\hat{u}^i$ where $\vec{E}_{I,II}$ are radiated fields of the modal currents $\vec{J}_{I,II}$ at the incidence direction. We now assume an RHCP incident field $<\vec{E}^i=|<\vec{E}^i|\hat{u}^{RHCP}$ is coming along a direction, not far from normal to the surface, so that both linearly polarized modal currents have the same radiated field amplitudes. In this situation, since the modal fields $\vec{E}_{I,II}$ have equal lengths and are orthogonal in spatial domain, it can easily be shown that $\vec{E}_I\cdot\hat{u}^{RHCP}\approx j\vec{E}_{II}\cdot\hat{u}^{RHCP}$ and therefore the modal excitation amplitudes $<\vec{E}^i, \vec{J}_{I,II}>$ have the same magnitudes but a 90° phase shift. These excitation amplitudes produce a LHCP scattered field $\vec{E}^{s0}$ with an axial ratio which is almost the same as that obtained from an LHCP port of the elements.

The above discussion indicates that the axial ratio $AR^s(\hat{k}^i, \omega)$ of the total scattered field $\vec{E}^s=\vec{E}^{sA}+\vec{E}^{s0}$ as a function of the frequency and the incidence angle, when the incident field is RHCP, is approximately given by:

$$AR^s(\hat{k}^i, \omega)\approx AR^{LHCP}(\hat{k}^i, \omega) \tag{14}$$

Therefore the axial ratio of the total returned field ($\vec{E}^r+\vec{E}^{s0}+\vec{E}^{sA}$) from the planar array under the RHCP illumination is approximately the same as that of the antenna devices fed from their LHCP ports.

The situation obviously changes when the incident field is far from normal to the surface. Equally, the axial ratio changes according to the specific antenna element.

Mutual effects in general deteriorate the input matching and scanning characteristics, decrease port isolation, and increase the cross polarization level. Two types of mutual effects, interaction between the polarization ports of each element, and the mutual impedance between the same polarization ports of the neighboring elements, are considered below.

Figure 7:
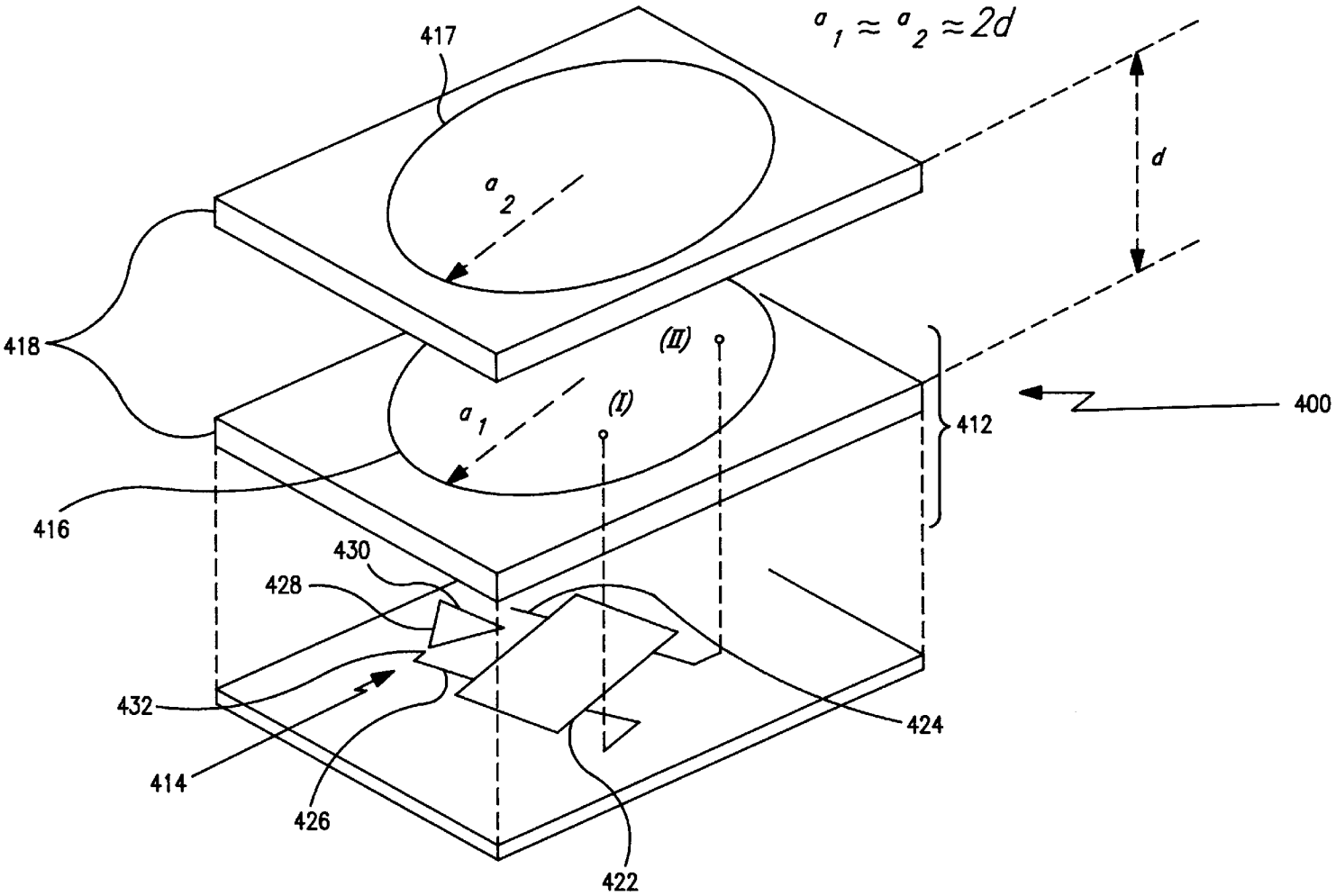
FIG. 7 shows a stacked disk antenna device, in accordance with the present inventon.

Each antenna device 10 produces a circularly polarized field by generating two orthogonal components and combining them in phase quadrature in a hybrid coupler circuit 22. To analyse the effect of mutual coupling on impedance mismatch at the antenna ports and polarization, we consider the element excitation scheme of FIG. 7. The cross-polarized RHCP and LHCP ports 24 and 26 are connected with the hybrid coupler circuit 22 to the linearly polarized ports "I" and "II" on the patch. We assume an impressed source wave is incident on LHCP port 26. To determine the excitation amplitudes at the antenna ports I and II the reflection coefficients at the other ports 24 and 26 of the hybrid should first be found.

The transmission line reflection coefficients at the linearly polarized ports, $\Gamma_I$ and $\Gamma_{II}$, which include all mutual interactions between the antenna elements and between the polarization ports on the same antenna, are functions of the incident wave direction.

Because of normally small amplitude of the cross-polarized component we assume that the mutual effects between different linearly polarized ports of different antennas are negligible. Adding the coupling $S_{I,II}$ between the linear ports on the same antenna element, the antenna ports' reflection coefficients $\Gamma_I$, and $\Gamma_{II}$ for a typical element, say the (0,0) cell, are:

$$\Gamma_I = \left[S_{00}^I + \sum_{m=0}\sum_{n=0} S_{mn}^I \exp(jk^i\cdot\vec{\rho}_{mn})\right] - jS_{I,II} \tag{16}$$

$$\Gamma_{II} = \left[S_{00}^{II} + \sum_{m=0}\sum_{n=0} S_{mn}^{II} \exp(jk^i\cdot\vec{\rho}_{mn})\right] - jS_{I,II}$$

$$\rho_{mn} = \max + nb\hat{y}$$

where $S_{mn}^{II}$ is the array scattering matrix element for linearly polarized ports which represents the coupling between similar ports of the elements m and n while the array is assumed to be under LHCP excitation.

The RHCP port 24 of the hybrid 22 is connected to the input of the amplifier 28 which has a reflection coefficient $\Gamma_m$. The LHCP port 26 is connected to the output of the amplifier. For a unit of available power input to LHCP port 26 of the hybrid from the amplifier in FIG. 11, the normalized amplitudes of excitation, total voltages, $a_{I,II}$ at the antenna linearly polarized ports I and II are easily derived through 90° hybrid 22 in FIG. 12:

$$a_I = (1+\Gamma_I)\left(-\frac{J}{\sqrt{2}} + \frac{a_{RHCP}^+}{\sqrt{2}}\right) \tag{17}$$

$$a_{II} = (1+\Gamma_{II})\left(-\frac{1}{\sqrt{2}} - j\frac{a_{RHCP}^+}{\sqrt{2}}\right)$$

$$a_{RHCP}^+ = \frac{-\frac{j}{2}\Gamma_\epsilon(\Gamma_I+\Gamma_{II})}{1+\frac{1}{2}\Gamma_\epsilon(\Gamma_{II}=\Gamma_I)}$$

where, solved from scattering matrix manipulation, $|a_{RHCP}^+|$ is the reflected normalized voltage from the amplifier input back to the RHCP port 24 of the hybrid and the lengths of the lines connecting hybrid ports to those of the amplifier 28 and antenna element 16 are assumed to be short. Under the normal conditions where reflections at various ports are small, $|a_{RHCP}^+|$ may be negligible.

Having found the excitation amplitudes $a_{I,II}$ at antenna ports I and II, we can determine an LHCP co-polarized component ($\vec{E}_c^{sA}$) and an RHCP cross-polarized component ($\vec{E}_x^{sA}$) with the mutual couplings and impedance mismatches taken into account:

$$|\vec{E}_c^{sA}| = |\vec{E}^{sA}|\left|\frac{a_I - ja_{II}}{\sqrt{2}}\right| \approx |\vec{E}^{sA}|\left|1 + j\Gamma_I + \frac{\Gamma_{II}}{2}\right| \tag{18}$$

$$|\vec{E}_x^{sA}| = |\vec{E}^{sA}|\left|\frac{a_I - ja_{II}}{\sqrt{2}}\right| \approx |\vec{E}^{sA}|\left|a_{RHCP}^{+} + j\Gamma_{II} - \frac{\Gamma_I}{2}\right| \tag{19}$$

where ($\vec{E}^{sA}$) is the reradiated field in the ideal case where there are no mismatches at the hybrid ports 24 and 26 and no mutual coupling between the antenna elements 16 in a planar array.

Equation (19) implies that if the antenna devices 10 have similar characteristics at their two ports I and II, then $\Gamma_I=\Gamma_{II}$ and the cross-polarized component ($\vec{E}_x^{sA}$) becomes negligibly small.

An active amplifying surface is inherently susceptible to unwanted self-oscillation at those frequencies where the built-in gain mechanism provides sufficient positive feedback for instabilities such as internal noises. To prevent the self-oscillation in operating frequency band of the system the amplifier gain should be lowered. A simple stability criterion and an upper bound on the amplifier gain are shown below.

Self-oscillation means the existence of the waves with non-zero amplitudes on the hybrid ports 24 and 26 in the absence of the incidence wave. To find the appropriate condition for self-oscillation, the hybrid 22 is considered to be embedded in a 4-port network composed of the antenna element 16 and the amplifier 28 with a scattering matrix:

$$\text{Embedding Network::}\ S^{PA} = \begin{pmatrix} S^P & 0 \\ 0 & S^A \end{pmatrix} \tag{20}$$

The ports of the hybrid and the embedding network are assumed to be interconnected such that the incident waves of one circuit are the reflected waves from the other circuit and vice versa. Therefore self-oscillation is only possible when the following linear system of equations have a non-zero solution:

$$S^{PA}S^{H}a^{+}=a^{+} \tag{21}$$

where:

$$a^{+}=[a_1^{+}, a_2^{+}, a_3^{+}, a_4^{+}]^{t},$$

is the vector of the amplitudes of the self-oscillating wave incident on the hybrid's ports. The matrix equation (21) only has a non-zero solution, where self-oscillation cannot occur, if:

$$D(\omega)=\|S^{PA}S^{H}-1\|\neq 0 \tag{22}$$

where $\| \ldots \|$ denotes the determinant of a matrix and 1 is the 4×4 identity matrix. The inequality (22) can be used as a stability criterion to determine the stable regions for different system parameters or their various combinations.

Of particular interest is estimating an upper bound for amplifier gain which ensures stable operation. It is reasonable to assume that in a useful system the antenna elements and the amplifiers have only small impedance mismatches at the input or output ports ($|\Gamma_I|<<1$, $|\Gamma_{II}|<<1$, $|s_{11}^{A}|<<1$, $|s_{22}^{A}|<<1$), and the amplifiers are almost unilateral ($|s_{12}^{A}|<<1$).

With these assumptions, neglecting the small quantities of second order, the determinant D(ω) can be estimated as:

$$D(\omega) \approx 1 - jS_{21}^{A}\left(\frac{\Gamma_I + \Gamma_{II}}{2}\right) \tag{23}$$

where $|s_{21}^{A}|^2$ is the transducer power gain of the amplifier with conjugately matched output and input. The input characteristics of each antenna element at ports I and II are almost the same ($\Gamma_I \approx \Gamma_{II}=\Gamma_0$). Therefore the following upper bound for the amplifier gain can be derived from (23):

$$|S_{21}^{A}| < \frac{1}{|\Gamma_0|} \tag{24}$$

It is to be noted that $\Gamma_0$ is not just a constant given by the antenna element structure but actually a function of the incidence, or reflection, direction. When the phase of the elements due to the incident field are appropriate for surface wave effects accumulation, there are strong mutual couplings leading to large reflection coefficients $\Gamma_{I,II}$ and scan-blindness effect. Under this situation a planar array becomes highly vulnerable to self-oscillation.

The element characteristics, material specifications, and the geometrical structure of a phased array of the present invention are determined, to a large extent, by its application. However, the array grid and the spacing between the elements are decided by the beam shape and the range of the incidence angles, or scan width in phased array terminology, and the aperture efficiency requirements of a specific system, and the level of mutual coupling between the elements that can be tolerated. To prevent grating lobes from being formed in the visible range for all incidence angles, according to (4), spacing between the elements should be less than half wavelength in free space. For a narrower range of the incidence angles in a receiving planar array, the spacing can be larger.

Referring back to FIG. 5, for a given array configuration or grid shape 210 spacings 212, with known dielectric thickness and permittivity, the range of the incidence angles, or scan width in beam scanning applications, is constrained by the scan-blindness effect. The total size of the planar array aperture is determined by the desired beamwidth or angular resolution in, for example, an imaging system.

In general, the polarization and the input impedance of an antenna element in an array environment vary with frequency and incidence angle. Wide band elements, such as slots cut on the micropatch and in its associated ground plane, with polarization characteristics less sensitive to incident direction are suitable choices.

Figure 8:
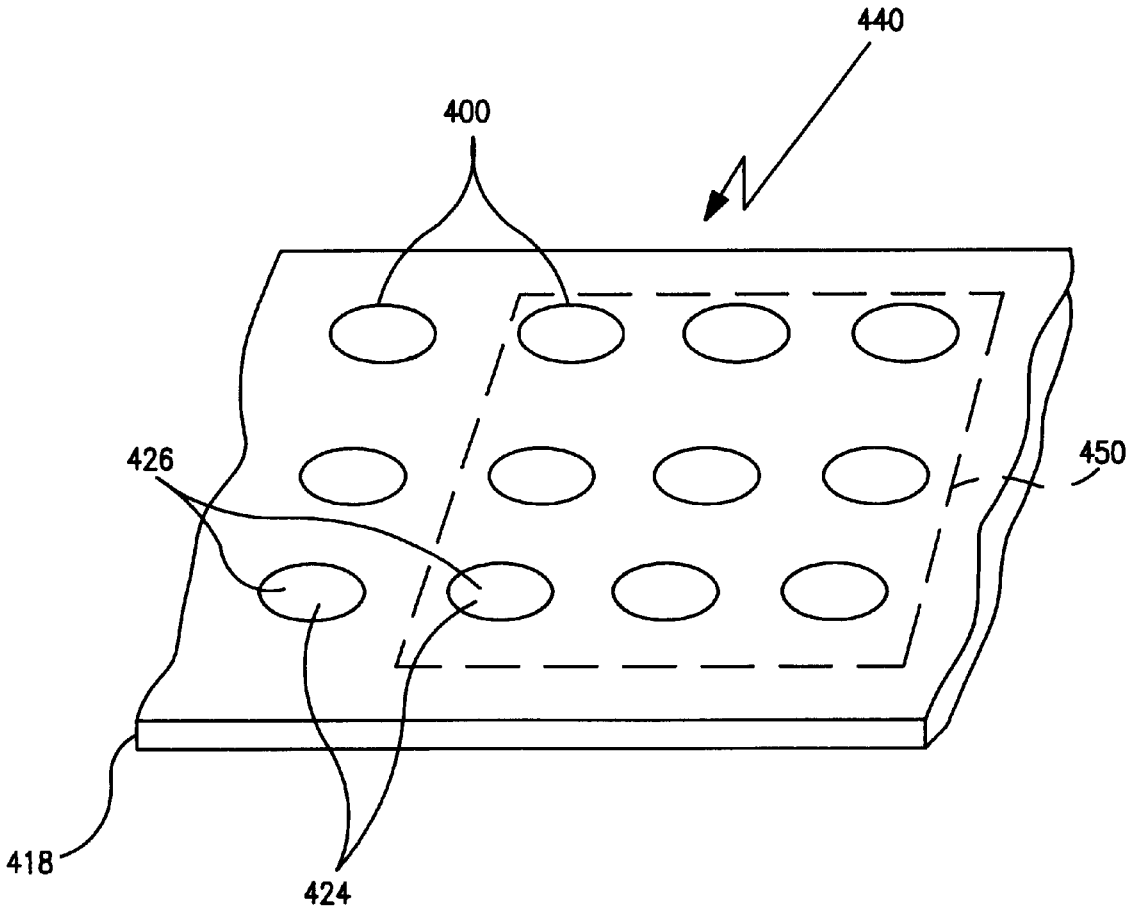
FIG. 8 is a perspective view of an array of the devices in FIG. 7.

For typical polarization ellipticity and VSWR bandwidths of 5% to 10% of a multi-beam communication, an active reflecting surface should use an array of elements which has comparable or larger corresponding bandwidths. As an example, dual fed circularly polarized (CP) stacked circular disks or rectangular micropatches in accordance with the present invention with more than 10% bandwidth as shown in FIG. 8 may be appropriate. FIG. 8 shows a circularly polarized stacked disk antenna device 400 with integrated amplifier 428 and hybrid 422, as a suitable element in accordance with the present invention for a 4% to 5% bandwidth active phased array reflecting surface. Device 400 is a dual circularly polarized active device consisting of an antenna subsystem 412 and an integrated active circuit 414. Antenna subsystem 412 consists of a driven micropatch antenna element 416 mounted on a dielectric substrate 418 and backed by a grounded conducting backplate 420. A parasitic antenna element 417 is formed on top of driven element 416. Driven element 416 is electrically connected to branch line hybrid circuit 422. Hybrid circuit 422 is electrically connected to active circuit 414 through two ports, a right-hand circularly polarized ("RHCP") port 424 and a left-hand circularly polarized ("LHCP") port 426, which are themselves interconnected by the low noise amplifier 428. An input 430 to amplifier 428 receives input from RHCP port 424, through hybrid circuit 422. An output 432 of amplifier 428 transmits output to LHCP port 426. Driven element 416 drives parasitic element 417 to, for example, reradiate a received and amplified incident wave.

To maintain polarization purity over an entire bandwidth, known notched element and four-probe feed configurations can be used to successfully suppress higher order modes. These techniques also improve the VSWR characteristics and the stability of an active reflecting surface by decreasing cross coupling ($S_{I,II}$) between orthogonal ports of each circularly polarized element caused by these modes. For large active reflecting surfaces, the more complex feed circuitry required by four-probe approach may be too cumbersome and therefore the notched element technique may be preferred.

Mutual coupling between adjacent elements and between orthogonal ports on each element should be small enough due to their adverse effects on stability and polarization purity. Mutual coupling introduces additional impedance mismatch at the antenna ports and the mismatch varies with the angle of incidence.

As previously discussed, spacings less than a half wavelength prevent grating lobes from being formed for all angles of incidence. At such spacings, mutual effects can often cause deterioration of the array performances. For many applications, such as imaging systems, the range of the incident angles, or field of view, is limited to ±20° or even less. In fact, for a large but finite active reflecting array, the reflection and the scattering pattern deteriorates as the incidence direction deviates from the normal to the surface. Therefore, to control the beam broadening and the sidelobe level to within acceptable tolerances, the scan width may have to be limited.

Antenna element reflection coefficients at linearly polarized ports increases with the incidence, or scan, angle. This lowers the stable gain given by (25) for oblique incidence. However, for an incident angle less than 20° and spacings 212 fo approximately half a wavelength the dielectric constant and substrate thickness can be chosen such that the magnitudes of the reflection coefficient at the antenna ports doe not increase more than 10%, and the scan-blindness angle is not less than 40° for more than 10% VSWR bandwidth.

A scan width of the order mentioned above can be achieved by spacings larger than half a wavelength. A suitable choice, for example, is around $0.68\lambda_0$, which results in a weak coupling less than −22 dB in both E- and H-planes. Mutual effects due to the surface wave propagation, can further be reduced by cutting slots in the substrates.

In general as the direction of incidence moves further from the broadside, the axial ratio, becomes larger. However when the incidence plane remains the same while the angle of incidence varies (1-D planar scanning), it is often possible to configure an array and orient the elements such that in the chosen plane of incidence the pair of orthogonal linear polarizations have similar radiation patterns. This improves the polarization purity for all incidence directions in that plane.

Mutual effects can also cause cross-polarization. But, as is indicated by (19), if the structure is symmetric and has similar characteristics at two orthogonal polarization ports ($\Gamma_I \approx \Gamma_{II}$), the cross-polarization component is usually very small. An advantage of $0.68\lambda_0$ spacing mentioned earlier is that the couplings in both E- and H-planes are nearly equal and so are the reflection coefficients $\Gamma_I$ and $\Gamma_{II}$ at the orthogonal ports of each element.

Figure 9:
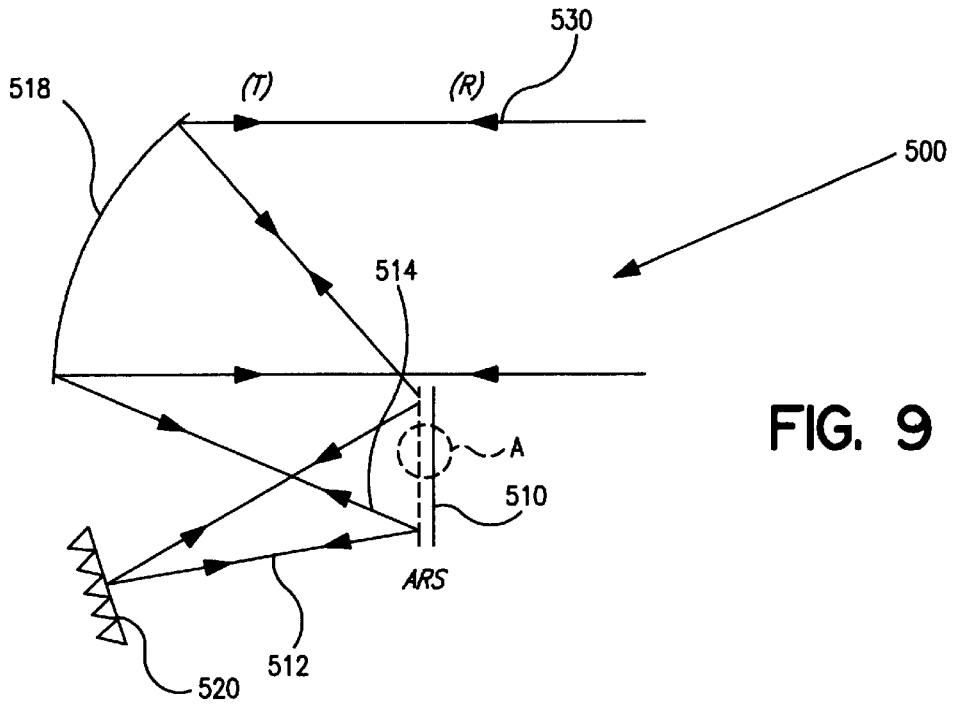
FIG. 9 shows an active micropatch array, in accordance with the present invention, as a subreflector for imaging or rapid beam scanning systems.

As an example, if we evaluate the performances of a typical active reflecting array consisting of the active circularly polarized antenna devices 400 shown in FIG. 8. The active reflecting array 440, partially illustrated in FIG. 9, is assumed to consist of a square array grid 450 with an element spacing 452 of approximately $0.68\lambda_0$ with almost equal coupling between the neighboring elements in both E- and H-planes.

The array 440 of singly fed wide band antenna devices 400 can typically offer (VSWR<1.5) bandwidths around 10% at each one of their linearly polarized ports. In the active reflecting array 440, each antenna device 400 is fed by two ports, 424 and 426. The printed element in an array environment fed by two ports cannot be treated as a single port device. Instead, a numerical analysis of an infinite array of two-port-fed circularly polarized elements can be used.

To estimate the input reflection coefficients $\Gamma_{I,II}$ of the two-probe-fed antenna element, we note that the first two terms in the bracket on the right hand side of (16) are the self reflection coefficient of a port and the couplings from the ports of other elements, but with the same linear polarization. These two terms may have a magnitude of 0.2, equivalent to VSWR=1.5. Couplings from ports of orthogonal polarization of other elements are generally negligible, except for the orthogonal port within the same patch as shown in FIG. 14*a*. This is the third term $S_{I,II}$ in (16). This term is usually less then −26 dB, or 0.05 in magnitude, over a 10% bandwidth. The result, using (16), is $|\Gamma_{I,II}|<0.25$ or −12 dB, which in turn according to (24) yields a maximum usable amplifier of 12 dB. Allowing a 3 dB gain margin a stable amplifier gain of $|s_{21}^A|\approx 9$ dB is obtained.

If the aperture efficiency of the array elements including the polarization and the impedance mismatches is taken to be 70% to 80%, equation (11) indicates that the active reflecting array 440 has about 7 to 8 dB reflection gain ($R_p$). The axial ratio of the array is less than 1 dB over the 5% bandwidth.

As will be apparent to those of skill in the art, an active phased array of the present invention consists of autonomous printed antenna elements each integrated with active circuitry. Such an array can be used for beam scanning, spatial power combining, frequency-polarization selective surfaces, multi-beam communication and imaging systems, and other related applications.

Active transmitting and reflecting arrays can also be designed to function, respectively, as transmitting and reflecting active counterparts of passive frequency selective surfaces (FSS) composed of micropatch elements. Such an active FSS can obviously work as a spatial power combiner or active filter.

An antenna system 500 having an active integrated reflecting array 510 according to the present invention is shown in FIG. 9. Compared to the conventional phased array systems, an advantage of the new architecture is that it does not require complex a lossy beam forming network and feed lines for centrally controlled phase shifters. The antenna system 500 can be used for imaging or rapid beam scanning systems. In general, the active reflecting array 510 receives an incident wave 512, which for the purposes of this discussion in RHCP, from a conventional focal plane array 520. As described above and as illustrated in the enlarged portion of array 510 seen in FIG. 10, the RHCP incident wave 512 is received, amplified, and reflected, or reradiated, by array 510 as a LHCP wave 514. The polarization diversity allows the same array to be used for both receiving and transmitting tasks, ie. RHCP for receiving and LHCP for transmitting, and thereby permits more efficient use of the aperture area, while exhibiting reasonable stable gain, bandwidth and polarization purity over a ±20° range of variation for the incidence angle or scan width. After being reradiated from array 510, the reflected wave 514 impinges on a reflector 518, and is transmitted to an object of interest, or communication system (not shown).

As will be apparent to those skilled in the art, antenna system 500 can also function in reverse to receive a signal from an object of interest, or communication system. An incident signal 530 is received by reflector 518, received, amplified and reradiated by array 510 to focal plane array 520.

Figure 11:
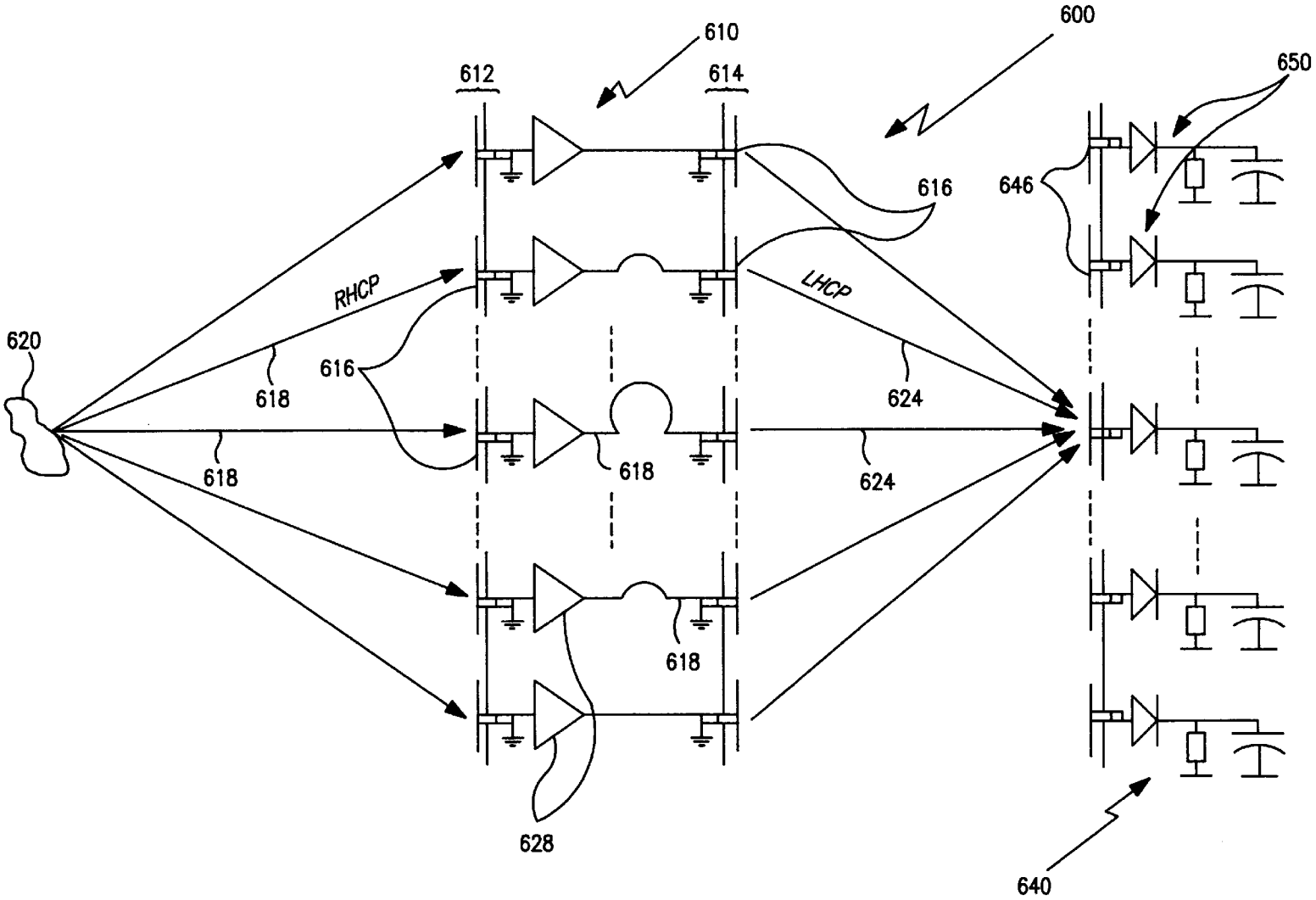
FIG. 11 shows an imaging system employing active transmitting array and a active imaging plane.

Further applications of the antenna device of the present invention are shown in FIG. 11 where a transmitting imaging system 600, modified from the system shown in FIG. 9, is illustrated. Imaging system 600 comprises an active integrated transmitting array 610 and an active integrated image array 640. Transmitting array 610 consists of separate planar arrays 612 and 614 of antenna devices 616, for receiving and transmitting respectively. The elements 616 of planar array 612 are connected, through delay lines 618 and amplifiers 628, to corresponding elements 616 in planar array 614, such that a signal transmitted from the elements in planar array 612 arrive in phase from the elements 616 to planar array 614. For example, planar array 612 receives an RHCP incident wave 618 from an object 620 being imaged. The received wave is amplified and arrives in phase at planar array 614. The wave is then transmitted by the elements of planar array 614 as an LHCP wave 624 to image array 640. Thus the active transmitting array 610 essentially functions as a flat lens. Active transmitting array 610 receives the incident wave field, amplifies it, converts its wave front, ie. focuses the wave front, using the elements' delay lines, or built-in fixed phase shifters provided by hybrid circuits (not shown), and transmits it to the other side of the surface.

The image plane array 640 shown in FIG. 11 receives the wave front at each antenna device 646, or pixel. Detector electronics 650 measure the intensity of the amplified signal for each device 646. In essence, image plane array 640 acts as a microwave equivalent of a charge-coupled device (CCD) in a video camera. Image plane array 640 can in fact be integrated with a CCD like electronics to sequentially transfer the pixel intensities to an appropriate image display (not shown).

Figure 10:
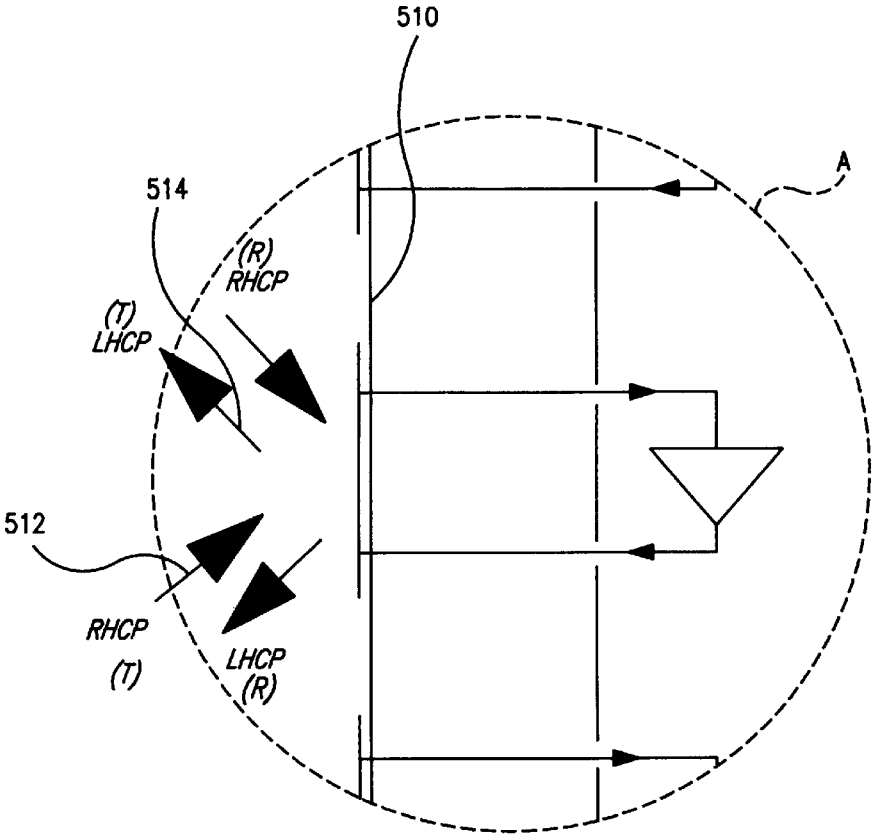
FIG. 10 is an enlarged view of the portion of FIG. 9 marked A.

As will be apparent to those of skill in the art, the active arrays above are arrays with autonomous antenna elements without RF links. As seen in FIGS. 9–11, the required antenna elements' phase shifts are self-generated at the reflector or lens. Their design and fabrication are therefore much easier and less expensive than the conventional phased arrays. Their autonomous modular structure leads to practically no RF conductor loss, and to reliable operation and graceful degradation from element failures. It is graceful in that each failure, be it antenna element or amplifier affects only the relevant element cell in the antenna array and not its neighbours. This is equivalent to the thinning of a random antenna array. It is known from the random array theory that a large random array can be thinned out by 10%, or 10% of the elements, without unduly affecting the performance of the array. A further consequence of such graceful degradation is a decreased sensitivity of the active array to fabrication errors, for example yiled in manufacturing, when compared to prior art phased arrays or other systems using interconnected elements. This is particularly advantageous for wafer level integration where the current yield is typically less than 50% when applied to prior art millimeter wave arrays with a large number of elements.

It is also contemplated that the active surface architecture of the arrays of the present invention has the unique possibility of integrating with photo-cells, as a separate dc source into each active element. With a light source therefore the dc power generation is distributed over the entire array without the centralized dc power supplies with bulky distribution networks. This feature makes the dc power system more reliable and the active modules more autonomous.

It will be apparent to those skilled in the art that the foregoing is by way of example only. Modifications, variations and alterations may be made to the described embodiments without departing from the scope of the invention which is defined solely in the claims.

We claim:

1. An active integrated antenna device, comprising:

a substrate;

at least one antenna element formed on said substrate;

a hybrid circuit formed on said substrate, and electrically communicating with said antenna element;

a first port, formed on said substrate, interconnecting an input of said hybrid circuit to said antenna element, said first port for receiving an input signal having a first circular polarization;

a second port, formed on said substrate, interconnecting an output of said hybrid circuit to said antenna element, said second port for returning an output signal having a second circular polarization opposite to said first circular polarization; and an active circuit formed on said substrate, said active circuit electrically communicating with said output of said hybrid circuit, said active circuit including an amplifier for amplifying said output signal.

2. A device according to claim 1 wherein said antenna element comprises a micropatch element, and wherein said substrate comprises a dielectric substrate having a grounded conductive backplate.

3. A device according to claim 2 wherein said active circuit comprises said amplifier operably electrically connected to a narrow bandpass filter for filtering spurious oscillations.

4. An integrated antenna array system, comprising:

a plurality of independent micropatch antenna devices integrally formed on a substrate;

each said plurality of micropatch antenna devices comprising an antenna element;

a hybrid circuit operably electrically communicating with said antenna element;

a first port interconnecting an input of said hybrid circuit to said antenna element, said first port for receiving an input signal having a first circular polarization;

a second port interconnecting an output of said hybrid circuit to said antenna element, said second port for returning an output signal having a second circular polarization opposite to said first circular polarization; and an active circuit electrically communicating with said output of said hybrid circuit, said active circuit including an amplifier for amplifying said output signal.

5. An array system according to claim 4 wherein said active circuit comprises said amplifier operably connected to a narrow bandpass filter for filtering spurious oscillations.

6. An array system according to claim 4 wherein said substrate comprises a dielectric substrate.

7. A microwave communication system comprising:

a microwave source for providing at least one microwave signal having a first circular polarization;

an integrated antenna array for receiving said at least one signal, said array comprising a plurality of independent micropatch antenna devices formed on a single substrate, each said plurality of micropatch antenna devices comprising: an antenna element; a hybrid circuit electrically communicating with said antenna element; a first port interconnecting an input of said hybrid circuit to said antenna element, said first port receiving said at least one microwave signal; a second port interconnecting an output of said hybrid circuit to said antenna element, said second port returning an output signal having a second circular polarization opposite to said first circular polarization; and an active circuit electrically communicating with said output of said hybrid circuit, said active circuit including an amplifier for amplifying said output signal prior; and a reflector for receiving said reflecting said amplified output signals, radiated by said plurality of independent micropatch antenna devices, to a receiving means.

8. A microwave imaging system comprising:

an integrated antenna array for receiving said at least one microwave signal having a first circular polarization, said array comprising a plurality of independent micropatch antenna devices formed on a single substrate, each said plurality of micropatch antenna devices comprising: an antenna element; a hybrid circuit electrically communicating with said antenna element; a first port interconnecting an input of said hybrid circuit to said antenna element, said first port receiving an input signal having a first circular polarization; a second port interconnecting an output of said hybrid circuit to said antenna element, said second port returning an output signal having a second circular polarization opposite to said first circular polarization; and an active circuit electrically communicating with said output of said hybrid circuit, said active circuit including an amplifier for amplifying said output signal; and an imaging means for receiving said amplified output signals from each said plurality of independent micropatch antenna devices, said imaging means including a plurality of detectors for detecting an intensity of said amplified output signals at a respective plurality of points on said imaging means.

9. An imaging system according to claim 8 wherein said imaging means is an integrated antenna array comprising a plurality of micropatch antenna devices, wherein each said antenna devices is an independent antenna device including an antenna subsystem having means for receiving said at least one amplified signal of opposite polarization, said antenna subsystem being operably connected to an integrally formed active circuit, said active circuit including means for amplifying said at least one amplified signal of opposite circular polarization, said active circuit further including detecting means for detecting said intensity.

* * * * *